United States Patent [19]

Karlsson

[11] Patent Number: 4,937,996

[45] Date of Patent: Jul. 3, 1990

[54] METAL FRAME ARRANGEMENTS

[75] Inventor: Arne Karlsson, Lysekil, Sweden

[73] Assignee: A/S Spilka Inco, Ltd., Alesund, Norway

[21] Appl. No.: 233,338

[22] Filed: Aug. 17, 1988

[30] Foreign Application Priority Data

Aug. 24, 1987 [NO] Norway ..... 873552

[51] Int. Cl.[5] ..... E04C 2/38

[52] U.S. Cl. ..... 52/658; 52/729; 52/781

[58] Field of Search ..... 52/656, 658, 781, 729, 52/631; 29/155 R; 72/339

[56] References Cited

U.S. PATENT DOCUMENTS

| | | | |
|---|---|---|---|
| 1,669,667 | 6/1928 | Levine | 52/658 |
| 3,478,483 | 11/1969 | Baker | 52/658 |
| 3,537,212 | 11/1970 | Gilles | 52/658 X |
| 3,802,105 | 4/1974 | Bendix | 52/658 X |
| 3,867,107 | 2/1975 | Long et al. | 52/658 X |
| 4,073,177 | 2/1978 | Leroux | 52/658 X |
| 4,084,720 | 4/1978 | Thurston | 52/658 X |
| 4,116,513 | 9/1978 | Ullman, Jr. | 52/658 X |
| 4,269,255 | 5/1981 | Nailor et al. | 52/658 X |
| 4,479,737 | 10/1984 | Bergh et al. | 52/658 X |
| 4,562,677 | 1/1986 | Hrabak | 52/658 X |

FOREIGN PATENT DOCUMENTS 333016 10/1976 Austria .

1394578 5/1975 United Kingdom .

*Primary Examiner*—David A. Scherbel
*Assistant Examiner*—Lan Mai
*Attorney, Agent, or Firm*—Kenyon & Kenyon

[57] ABSTRACT

A metal frame arrangement (20, 21), for use as or in door frames, window frames (22), window casements (23) or the like, comprising a frame made of concave metal profile. The frame comprises two pairs of mutually opposite frame portions which are angled at right angles relative to the adjacent neighboring frame portion. The frame (20, 21) is made into a coherent piece in a longitudinal continuous and sectionally angled contour, by means of local cavities in the metal profile and longitudinal deformation of locally uncovered portions of the metal profile, the deformation by means of the material of the metal profile forming angle reinforcing and angle bracing means (32', 38) just by the apex of the angle between two neighboring frame portions.

A process for the production of the metal frame comprises that cavities in a side portion or side portions of the profile are removed, after which a section of web portion (20c) or one web portion (21f) of the profile uncovered by the cavity is finished to form an angle bracing and angle reinforcing means (32', 38) for establishing frame portions angled at right angles relative to each other. The angle bracing is effected simultaneously with the undertaking of the angle bending of the frame plate.

17 Claims, 4 Drawing Sheets

METAL FRAME ARRANGEMENTS

Figure 1:
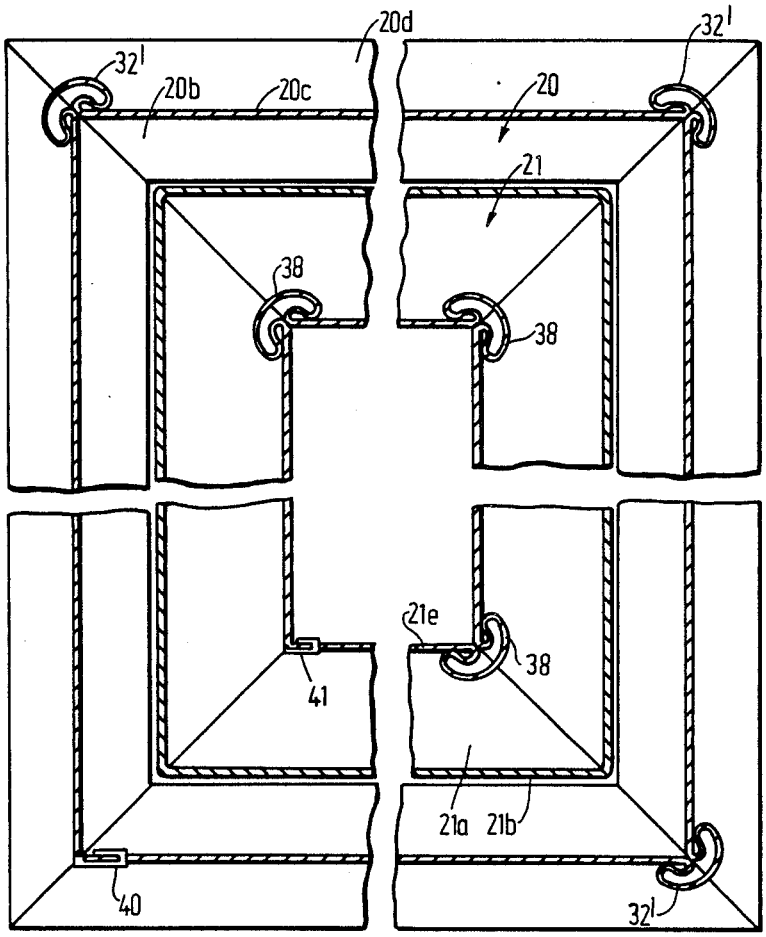

This invention relates to a metal frame arrangement, for use as or in door frames, window frames, window casements or the like.

It has been usual in the manufacture of metal frames which are to be used for door frames, window casements or the like, to fabricate the frame members in sections and to join together the frame members at the four corners of the frame by means of special mountings, for example corner angles and/or by means of special fastening devices, including fastening screws and fastening means for these. In addition to the operations of cutting off the frame members and special finishing of the frame members end individually, significant work and extra materials are required for the production and finishing of mountings, fastening means, and the like, together with laborious mounting of these between each pair of mutually adjacent frame members, together with intermediate storage of members, which demands space and storage in a precise system.

Simple frames of L-shape, C-shape or T-shape profile are also known where cavities have been made in the profile portion or one pair of profile portions of the profile in connection with a bending of a remaining profile portion. In such cases, one ottains rather limited bracing of corners of the frame and a significant weakening of the profile at the corner portions. Such simple frames are little suited for use in window casements, window frames, door frames, and the like.

From United Kingdom Patent Specification No. 1,394,578 it is known to brace and join together separate frame members of a profile of a synthetic plastics material, at each of the corners of the frame, with the aid of separately made reinforcing members of metal profile which are bent into a V shape after cavities have been made in side portions of the profile.

In AT Patent Specification No. 333,016 there are shown reinforcing strips which are separately fastened to separate frame components. After assembling the frame components at right angles relative to each other, an extension of the reinforcing strips on the two frame components is bent into supporting abutment against the neighbouring frame component.

The mode of manufacture and the mode of mounting of window casements, window frames, door frames, and the like, such as has been effected hitherto, is little suited for economic mechanical production or for mass production, as a consequence of the general design of the metal profiles employed.

Accordingly, it is an object of the invention to provide a frame construction which is well suited for the manufacture of frames of metal profile for doors, windows and the like, in moderate quantities as well as for mass production.

It is another object of the invention to avoid mounting operations or at least limit mounting operations to a minimum.

It is another object of the invention to permit continuous production of metal profiles for window and door frames which is simple to automate.

With the present invention, the aim is to produce a metal frame which is sufficiently rigid and strong to take up the stresses which arise in practice, without being dependent on extra rigidity and strength from other components. In this way, there is a possibility, if this is preferred, of employing, for example, separate wooden frame members which are fastened separately to the metal frame but which must not necessarily, form in themselves a coherent wooden frame.

With the present invention, one has particularly in mind a frame construction which is made up of a metal frame facing towards the outside air and a wooden frame facing towards a room within. In such frame constructions, the metal frame is included as the bracing and reinforcing element of the frame construction, while the wooden frame mainly serves as a covering means and insulation on the inwardly facing side of the frame construction, that is to say on the side which faces inwards into the room present inside.

Accordingly, the present invention resides in a metal frame arrangement for use as or in a door frame, window frame or window casement comprising a frame made of concave metal profile in a coherent piece with a longitudinally continuous and sectionally angled contour to form a rectangular annular frame. The frame comprises two pairs of mutually opposite frame portions which are angled relative to their adjacent frame portions to define local cavities for local bending thereof, said cavities having uncovered sections of a longitudinal portion of said metal profile which are fashioned by deformation in a direction which is at least one of longitudinal and lateral into one piece with said metal profile to form angle-reinforcing and angle-bracing means just at the apex of the angle between each pair of mutually coherent frame portions.

By the solution according to the invention, there is achieved, with the aid of simple means, an effective bracing and extra locking of each corner portion of the frame. In that this bracing and locking can be effected with the material of the frame profile itself by means of relatively simple finishing operations, it is possible to arrive at an automatised mass production of such frames at the same time as making oneself independent of separate fastening means.

The invention also includes a process for producing a frame for use as or in a door frame, window frame or window casement and made of a concave metal profile in a coherent piece with a longitudinally continuous and sectionally angled contour to form a rectangular annular frame, which comprises forming local cavities in the metal profile and effecting at these cavities local bending of said metal profile to form a frame with two pairs of mutually opposite frame portions which are angled relative to their adjacent frame portions, local sections of a longitudinal profile portion of the metal profile being uncovered during the formation of said local cavities and being deformed during bending of said metal profile to form said frame in a direction which is at least one of longitudinal and lateral to form their respective angle-reinforcing and angle-bracing means just at the apex of the angle between each pair of mutually coherent neighbouring frame portions during simultaneous establishment of a predetermined angle between said frame portions.

In the afore-mentioned solution, the metal frame can be produced in an especially simple and ready manner in one piece, for example, by an introductory stamping operation which is followed by a combined bending and deformation operation, effected in a coherent metal profile of a length suitable for this. This production can take place during employment of a single metal profile piece which in itself can constitute all the necessary material in the finished metal frame. More specifically, by the aid of relatively simple operations one can obtain the length of metal profile finally fashioned into a coherent, closed annular form and, in the end, obtain the finally fabricated metal frame by a simple coupling together of the ends of the length of metal profile bent towards each other.

For joining together the ends bent towards each other, there can be employed especially simple joint means as a consequence of the remaining bending of the frame. Preferably, the joint means can be formed in opposite ends of the metal profile itself, that is to say designed in the frame material itself. In this way, there is a possibility also of automatising the manufacture mechanically as regards the final fabrication of the frame and effecting the whole manufacture of the frame without being dependent on extra fastening members or remaining fastening means. Consequently there can then be avoided any usual mounting operation in the manufacture of the frame, and the fabrication can be effected in a more or less coherent sequence of working operations directly in the metal profile.

One can control the bending in a simple bending operation by accurately fashioning the support surfaces so that corners of the frame are similarly accurately designed and set precisely at a 90° angle.

The invention is not limited to specific metal profiles but can generally be employed for relatively simple profiles as well as for more complex profiles. That is, the invention may be employed with simple profiles having a side or flange portion and two web portions, essentially being of C-shape cross section, or with two opposite side or flange portions and an intermediate web portion, essentially being of H-shaped cross section. The profile may also have a relatively large number of flanges or similar projections for closed (pipe-shaped) concave profiles. By the expression "side portion" is meant a portion which forms a side of a frame parallel to the main plane of the frame while the expression "web portion" means a portion which passes across the main plane of the frame.

Figure 2:
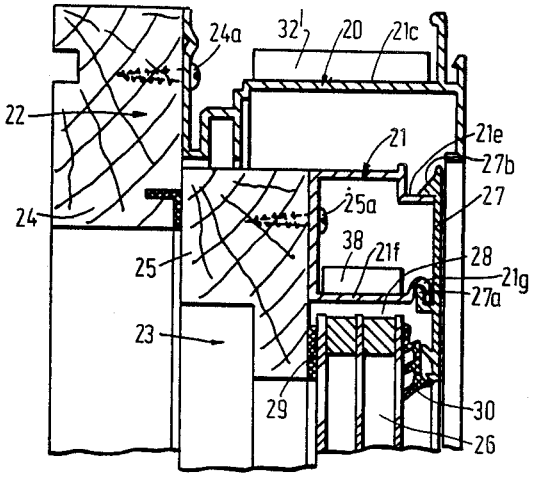
Figure 3:
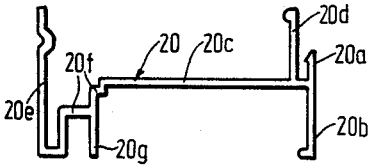
Figure 7:
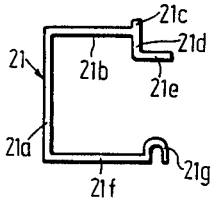
Figure 4:
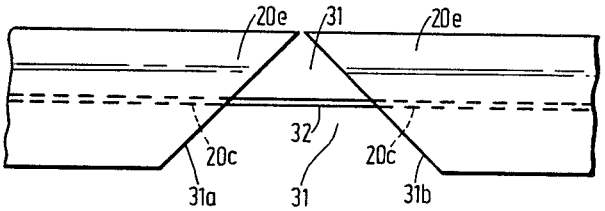
Figure 5:
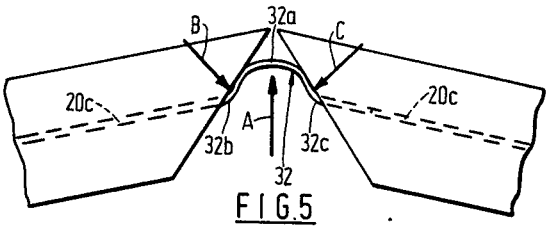
Figure 6:
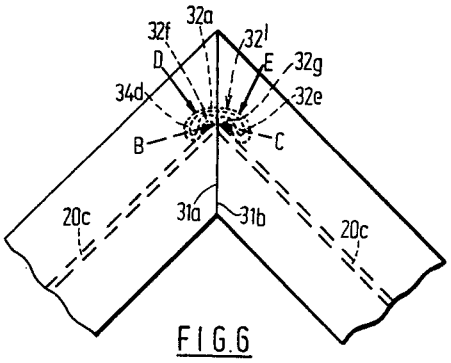
Figure 8:
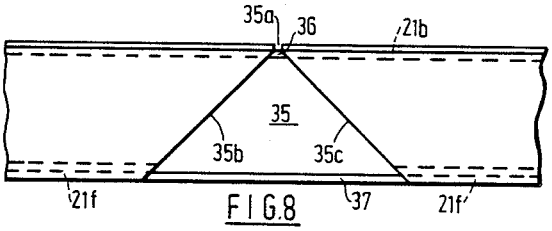
Figure 9:
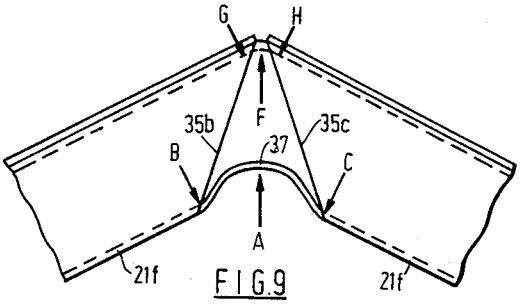
Figure 10:
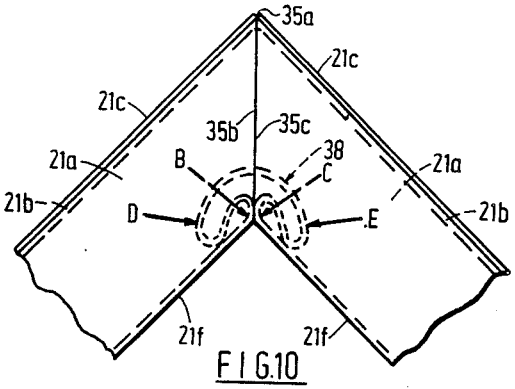

In order that the invention can be more clearly understood, convenient embodiments thereof will now be described, by way of example, with reference to the accompanying drawings in which:

FIG. 1 is a vertical section centrally through a window, with the section disposed parallel to the main plane of the window, there being illustrated metal frames (window frame and window casement) of the window, FIG. 2 is, in part, a corner portion of a window illustrated in a vertical section across the main plane of the window, where there is shown the connection between metal frames and wooden frames of the window, FIG. 3 is, in part, a portion of a first profile blank which forms a part of the frame which constitutes a main component, that is to say a metal frame in a window frame, FIGS. 4–6 illustrate consecutive steps of forming the profile blank according to FIG. 3, FIG. 7 is, in a section corresponding to FIG. 2, the cross-section of the profile blank which constitutes say a metal frame in a window casement, FIGS. 8–10 illustrate steps of forming the profile blank according to FIG. 7.

Figure 11:
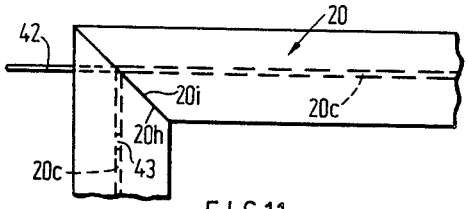
Figure 12:
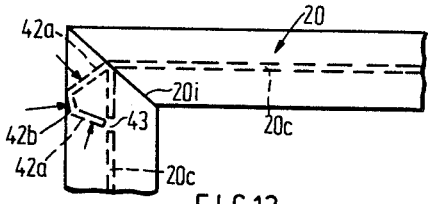
Figure 13:
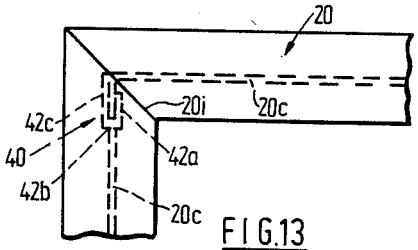

FIG. 11 is, in part, a fourth corner portion of a profile frame as shown correspondingly in FIG. 3 after the three remaining corner portions are formed such as shown in FIG. 6, FIGS. 12–13 are different consecutive steps for forming the profile blank according to FIG. 11.

Referring to FIG. 1, there are shown two different frames 20 and 21, which form a part of a window, that is to say a first frame 20, which constitutes a main component of a window frame 22 as shown in FIG. 2, and a second frame 21, which constitutes a main component of a window casement 23 as illustrated in FIG. 2.

More specifically, the window frame 22 comprises a main component 20 made of aluminium profile which constitutes the component of the window frame which faces outwards towards the outside air. Further, the window frame comprises a facing component 24 of wood which faces towards a room present within. The aluminium profile component or frame 20 is fastened by means of screws 24*a* to the facing component 24.

Similarly, the window casement 23 comprises a main component 21 made of aluminium profile which constitutes the component of the window casement which faces outwards towards the outside air. Further, the window casement 23 comprises a facing component 25 of wood which faces towards the room present within. The aluminium profile component or frame 21 is fastened with screws 25*a* to the facing component 25.

The facing components 24 and 25 can, in certain instances, be fastened in the form of separate members directly and separately to the frame 20 and 21 respectively. In other instances, the facing components 24 and 25 can, in themselves, constitute a wooden frame which is fastened to its respective frame 20 and 21.

As regards the window casement 23, a window pane 26 (in the illustrated embodiment a three-layered insulating glass pane) is fastened by means of cover pieces 27 in a rebate 28 between the main component 21 and the facing component 25. The window pane 26 forms lateral abutments against the facing component 25 and against the cover piece 27 via usual sealing strips 29, 30.

The case frame 20, which forms a part of the window frame, has a profile as shown separately in FIG. 3 and is in the form of an aluminium profile known per se, more specifically an essentially H-shaped profile. There is illustrated in FIG. 1–3, a first outer side portion 20*a* and a second outer side portion 20*b* which project outwardly on their respective sides of a transverse web portion 20*c*. A distance within the first outer side portion 20*a*, there is shown a third, outer side portion 20*d* present inside. At the opposite side of the profile, there is shown an inner side portion 20*e* which is connected to the web portion 20*c* via a transition portion 20*f* extending in a zig-zag with an associated inner flange 20*g*.

In FIG. 4, there is shown a side view of the aluminium profile according to FIG. 3, after there is effected a finishing of the profile, that is to say a stamping of a cavity 31 in opposite side portions of the profile as shown at the side portion 20*e*. Without being shown in the drawing, there is taken out an equivalent cavity also in the side portion 20*a*, 20*b*, 20*d* which lies opposite the side portion 20*e* i.e. in co-planar relation. The cavities are made just inwardly of the straight portion of web portion 20*c* of the profile. In other words, two sections of aluminium profile length are connected longitudinally to each other only by means of the web portion 20*c*, remaining portions of the profile being removed at the cavities 31.

As shown in FIG. 4, the cavity 31 has essentially the form of a right angled, isosceles triangle, where equal legs 31*a* and 31*b* of the triangle form lateral limits for each frame member or each section in the length of the aluminium profile. At the bottom of the triangle, that is to say at the longest side of the triangle, there is a maximum distance between the legs 31*a* and 31*b* while legs of the profile at the top angle of the triangle are mutually separated by a narrow gap. If there is a need for it, the length of the gap can be increased, as required. The web portion 20*c* is, as showm in FIG. 4, uncovered above a section 32. The length of the gap 31*c* can be adapted according to the desired length of the section 32. Instead of a triangular cavity, there can be employed another multi-sided shape, that is so say a trapezoidal cavity.

In FIG. 5, there is shown the profile with an introductory bending of the uncovered section 32 of the web portion 20*c*. By the arrow A, there is shown a lower support abutment against the central portion 32*a* of the uncovered section 32 (for example, by means of a convexly curved support means). By the arrows B and C, there are indicated tapered pressure means which are adapted to form abutments against the web portion 20*c*, more specifically with abutments in each respective limited region 32*b* and 32*c* of the uncovered section 32 at the respective transition port in the cavity 31.

In FIG. 6, the profile is shown with a further bending of the uncovered section 32 of the web portion 20*c* between two neighbouring frame members. In FIG. 6, the support abutment is removed, as shown by the arrow A in FIG. 5. In this fabrication phase, the pressure means form, as shown by the arrows B and C, by way of introduction in this phase, support abutments in the regions 32*b* and 32*c*, while additional clamp means, as indicated by the arrows D and E, form abutments against and exert pressure against certain side portions 32*d* and 32*e* of central portion 32*a* of the section 32. Finally, the pressure means are removed, as indicated at B and C, and by further clamping action from the clamp means, as indicated by D and E, there is ensured a stretching effect in the central portion 32*a*, including the portions 32*d*, 32*e*, while there is correspondingly ensured a pressure effect in the portions 32*f* and 32*g*. The short pressure-absorbing inner bow portions 32*f* and 32*g* have together a substantially shorter dimension than the outer stress-absorbing central bow portion 32*a* so that the portions 32*f* and 32*g* can be pressed endways, tightly together, by the clamping effect from the clamp means D and E against the portions 32*d* and 32*e*. Simultaneously with the tight pressing together of the portions 32*f* and 32*g*, one ensures that the limiting edges, as illustrated by edges 31*a* and 31*b* of the cavity, are pressed correspondingly tightly together for limiting a precise 90° angle between the bent neighbouring frame members. By means of the bent section 32 of the web portion 20*c*, there is formed a combined bracing means and locking means 32' between the neighbouring frame members, that is to say a means 32' formed by the web portion 20*c* itself in the profile of the frame 20. The means 32', which forms bracing and locking means for the neighbouring frame members, constitutes consequently a unitary portion of the frame itself and forms a thickened (folded together) and through-going connection between the neighbouring frame members.

As is shown in FIG. 1, the means 32' between the pairs of neighbouring frame members are arranged outside the web portion, that is to say in the space which is defined between web portion 20*c* of the profile and side portion 20*d* together with side portions 20*e* and 20*f*, while the concave space of the frame along the web portion 20*c* is shown completely level and smooth.

In FIG. 7, there is shown the cross-section of the metal frame component 21 of the window casement, the profile being illustrated in the form of an aluminium profile known per se with an approximately C-shaped cross-section. The profile is shown with a central, level side portion 21*a*. From the side portion 21*a*, there projects laterally outwards an outer web portion 21*b* with an outwardly angled flange 21*c* and an inwardly angled transition portion 21*d* to a laterally directed flange 21*e*. From the side portion 21*a*, there projects additionally laterally outwards an inner web portion 21*f* which is provided outermost with a U-shaped hook portion 21*g*.

The afore-mentioned cover member 27 is fastened in place on inner web portion 21*f* of the profile 21 in that an L-shaped locking member portion 27*a* is received in hook portion part 21*g* of the profile 21, while a support lug 27*b* forms support against flange 21*e* (see FIG. 2) of the outer web portion 21*b*.

As shown in FIG. 8, the profile 21 in the starting position is straight. Provision is made to form a first smaller cavity (not shown) in the hook portion part 21*g* of the profile and in the portions 21*c*, 21*d*, 21*e* and to form in the side portion 21*a*, another right angled, isosceles, triangle-shaped cavity 35, that is to say a cavity 35 flush with the first smaller cavity. The cavity 35 uncovers outer web portion 21*b* of the profile over a section 36 of minimum dimension at the top of the triangle 35*a* of the cavity 35 and uncovers inner web portion 21*f* of the profile over a substantially larger section 37 at the bottom of the triangle of the cavity 35. The first cavity uncovers the profile correspondingly as shown by the sections 36 and 37. By this, the profile can be bent, as is shown in FIGS. 9 and 10, there being fashioned gradually stops and support abutments between isosceles triangle leg 35*b* and 35*c* of the cavity 35. Also in the construction according to FIG. 7–10, there can be employed instead of a triangular shape another multi-edged shape, such as a trapezoidal shape.

It is evident from FIGS. 9 and 10 that outer web portion 21*b* of the profile 21, as shown by the section 36, is bent to a 90° angle, by means of an inner support abutment as shown by arrow F and outer pressure means, as illustrated by the arrows G and H, while the legs 35*b* and 35*c* of the triangle form support abutments against each other. Similarly, it is evident from FIG. 9 and 10 that inner web portion 21*f* of the profile 21 at the section 37, is bent in an equivalent manner as shown and described for web portion 20*c* of the profile 20, by means of an inner support abutment, as shown by an arrow A, and outer pressure means, as shown by arrows B and C and clamp means as shown by the arrows D and E. Consequently, there is formed, in the section 37, a bracing and locking means 38 which secures frame members of the profile 21 in the position shown in FIG. 10.

Consequently, the outer web portion 21*b* will pass continuously at the outer periphery of the frame, while the inner web portion 21*f* will extend pressed together, but continuously at the inner periphery of the frame. By this, there is achieved an effectively braced, solid frame, frame members of the profile between the formed sections 36 and 37 (FIG. 8) forming support abutments towards each other along the edges 35*b*, 35*c* of the cavity 35 in associated side portion 21*a* of the profile. In addition, there can be obtained a similar support abutment in corresponding bevelled edges at the outwardly opening side of the profile.

It is clear that the frames 20 and 21, which are described above and shown in FIG. 1–10, can be fashioned separately in the same sequence with three frame corners in a manner corresponding to that shown in FIG. 4–6 and 8–10. In the same sequence, the fourth corner of the frame 20 can also be fashioned with a bracing and locking connection 40 and the fourth corner of the frame 21 with a bracing and locking connection 41. In FIGS. 11–13, there are shown subsequent production steps during the fashioning of the connection 40 in the frame 20, the connection 41 in the frame 21 being able to be fashioned in a manner corresponding to that for the connection 40, without this being shown specifically in detail.

In FIG. 11, the frame 20 is shown at the fourth corner, after the three remaining corners are finally bent such as shown in FIG. 6. The two neighbouring frame members in the fourth corner are provided with their respective obliquely cut off side edges 20*h* and 20*i*. The one of the frame members is provided with an uncovered section 42 of the web portion 20*c*, while the adjacent second frame member in the fourth corner is provided with a transverse slot 43 in the web portion 20*c*. The uncovered section 42 of the one frame member forms an endways, outwardly projecting locking tongue which is to be connected to the locking member-forming slot 43 in the second frame member.

In FIG. 12, the locking tongue 42 is shown in a partially folded condition, that is to say with three successive portions 42*a*, 42*b* and 42*c* bent mutually and relative to the web 20*c* with outer portion 42*c* of the locking tongue arranged just by the inlet to the slot 43. In FIG. 13, the locking tongue is shown after the portion 42*a* is threaded into place through the slot 43 and is clamped into abutment against the one side of the web portion of the second frame member, while the outer portion 42*c* is clamped into abutment against the opposite side of the web portion, and the intermediate portion 42*b* is received in the slot 43.

In this way, locking means 42, 43 have been fashioned out of the material of web portion 20*c*, and these locking means have been joined into an effective locking engagement immediately after the three remaining corners of the frame are set separately at a 90° angle. The locking means 42, 43 correspondingly lock the fourth corner at a 90° angle. By this, there is obtained an effective locking up of each of four corners of the frame with the aid of locking means made of material of the aluminium material itself and directly connected to the aluminium profile.

What is claimed is:

1. A metal frame comprising a one-piece metal profile for bending into a rectangular frame, said profile having at least one discontinuous flange with pairs of opposed edges at three respective corners of said frame and a continuous web portion deformably bent into a kidney shape on itself at said respective corners of said frame to press said edges of said flange together in pressed relation.

2. A metal frames as set forth in claim 1 wherein a first terminal end of said web portion has a slot and a second terminal end of said web portion extends beyond said flange and is deformably bent into and through said slot.

3. A metal frame as set forth in claim 1 wherein said profile is of H-shaped cross-section.

4. A metal frame as set forth in claim 1 wherein said profile is of C-shaped cross-section.

5. A metal frame as set forth in claim 1 wherein each cavity has the form of an isosceles polygon prior to bending said profile into an angled frame contour, two legs of the polygon being adapted to form support abutments against each other at mutually impacting support surfaces between pairs of impacting frame portions to form frame portions angled at precisely 90°, while at least one locally uncovered section forms after deformation an angle-reinforcing and angle-bracing means for permanently abutting said support abutments against each other.

6. A metal frame as set forth in claim 1 wherein said web portion is bent at each said corner into the shape of a kidney with a convexly bowed outer surface and a concavely bowed inner surface having a central portion at each said corner.

7. A metal frame as set forth in claim 6, wherein the kidney shape is somewhat flat and squeezed.

8. A metal frame as set forth in claim 1 wherein said bent web portion is unconnected to side portions of said metal profile and defines a pair of short pressure-absorbing inner bow portion and an outer intermediate stress-absorbing bow portion having a longitudinal dimension considerably larger than the combined length of said inner bow portions.

9. The arrangement of claim 8, wherein the inner bow portions are of rectilinear form while the outer bow portion is of arcuate form.

10. A metal frame comprising:

a one-piece metal profile bent into a rectangular frame, said profile having a pair of vertically disposed dis-continuous co-linear portions at at least one corner of said frame disposed in facing relation to each other and a prependicularly disposed continuous portion integral with said co-linear portions and having a bent section at said corner overlying adjacent straight sections of said continuous portion to brace and lock said co-linear portions together.

11. A metal frame as set forth in claim 10 wherein said bent section is of kidney shape.

12. A metal frame as set forth in claim 10 wherein said profile is of C-shaped cross-section 13. A metal frame as set forth in claim 10 wherein said profile is of H-shaped cross-section.

14. A metal profile blank for a rectangular frame having:

a continuous web portion; and a plurality of flanges extending perpendicularly from said web, each said flange having at least one cavity therein in co-planar relation with a cavity in the remaining flanges to define a gap between a pair of opposed edges of said respective flange, said edges being disposed in angular relation to each other with said web portion extending across said cavity and being capable of bending to permit said edges of each flange to abut each other.

15. A metal profile blank as set forth in claim 14 wherein said flanges and said web portion define an H-shaped cross-section.

16. A metal profile blank as set forth in claim 15 wherein said flanges are provided with co-planar cavities at three locations to permit bending into a rectangular frame.

17. A metal profile blank as set forth in claim 15 wherein a first terminal end of said web portion has a slot and a second terminal end of said web portion extends beyond said flanges and is deformable for fitting into and through said slot.

* * * * *

UNITED STATES PATENT AND TRADEMARK OFFICE

CERTIFICATE OF CORRECTION

PATENT NO. : 4,937,996

DATED : July 3, 1990

INVENTOR(S) : Arne Karlsson

It is certified that error appears in the above-identified patent and that said Letters Patent is hereby corrected as shown below:

Column 1, line 16, change "end" to -ends-
Column 1, line 16, change "members" to -member-
Column 1, line 27, change "ottains" to -obtains-
Column 3, line 61, change "constitutes say" to -constitutes-
Column 5, line 7, change "showm" to -shown-
Column 7, line 60, change "frames" to -frame-

Signed and Sealed this

Eighteenth Day of February, 1992

*Attest:*

HARRY F. MANBECK, JR.

*Attesting Officer*

*Commissioner of Patents and Trademarks*